US009386672B2

(12) United States Patent
Ceccucci et al.

(10) Patent No.: US 9,386,672 B2
(45) Date of Patent: Jul. 5, 2016

(54) METHOD AND DRIVING DEVICE FOR RUNNING UP A DISCHARGE LAMP

(71) Applicant: KONINKLIJKE PHILIPS N.V., Eindhoven (NL)

(72) Inventors: Giovanni Ceccucci, Turnhout (BE); Vincent Van Broekhoven, Turnhout (BE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/401,558

(22) PCT Filed: May 9, 2013

(86) PCT No.: PCT/IB2013/053740

§ 371 (c)(1),
(2) Date: Nov. 17, 2014

(87) PCT Pub. No.: WO2013/175334

PCT Pub. Date: Nov. 28, 2013

(65) Prior Publication Data

US 2015/0173161 A1 Jun. 18, 2015

Related U.S. Application Data

(60) Provisional application No. 61/649,390, filed on May 21, 2012.

(51) Int. Cl.

| | |
|---|---|
| ***H05B 37/02*** | (2006.01) |
| ***H05B 41/30*** | (2006.01) |
| ***H05B 41/38*** | (2006.01) |

(52) U.S. Cl.

CPC ..... *H05B 41/30* (2013.01); *H05B 41/388* (2013.01)

(58) Field of Classification Search

CPC ..... H05B 33/0815; H05B 33/0818; H05B 37/029; H05B 37/02; H05B 41/3925; H05B 41/391; H05B 41/2828; H05B 33/0803

USPC ..... 315/291, 294, 224, 312, 132

See application file for complete search history.

(56) References Cited

U.S. PATENT DOCUMENTS 5,546,300 A * 8/1996 Lee ..... H02M 7/53871 315/209 R 6,300,725 B1 * 10/2001 Zinkler ..... H05B 41/245 315/224

(Continued)

FOREIGN PATENT DOCUMENTS

WO 2006072858 A2 7/2006

*Primary Examiner* — Douglas W Owens
*Assistant Examiner* — Syed M Kaiser

(57) ABSTRACT

The present invention relates to a method of running up a discharge lamp (1), in particular a UHP or HID lamp, in which a driving power (8) is increased or decreased to a target value during a single or during a plurality, for example two, of consecutive time periods. The method can comprise the steps of controlling the driving current (5) of the lamp (1) to keep constant during the first of said two or more consecutive time periods, if applicable, and controlling the driving power (8) of the lamp (1) to reach the power target value during the single or during the last time period. The driving current (5) of the lamp (1) is not allowed during the single or following time periods to increase faster than a preset rate and to exceed a fixed upper current limit, which can be selected to avoid an overheating of the electrodes of the lamp (1). With the proposed method and the driving device adapted to carry out the method, the risk of overheating the electrode tips of the discharge lamp during run-up is significantly reduced.

14 Claims, 1 Drawing Sheet

(56) References Cited

U.S. PATENT DOCUMENTS 6,515,437 B1 * 2/2003 Zinkler ..... H05B 41/245 315/291
7,084,581 B2 8/2006 Honma
2005/0177141 A1 * 8/2005 Davenport ..... A61B 18/203 606/9
2008/0315790 A1 * 12/2008 Ikeda ..... H05B 41/2883 315/294
2009/0079365 A1 3/2009 Chen
2009/0093799 A1 * 4/2009 Davenport ..... A61N 5/0616 606/9
2009/0096385 A1 * 4/2009 Yamauchi ..... H05B 41/2928 315/291
2010/0177286 A1 7/2010 Ikeda

* cited by examiner

METHOD AND DRIVING DEVICE FOR RUNNING UP A DISCHARGE LAMP

CROSS-REFERENCE TO PRIOR APPLICATIONS

This application is the U.S. National Phase application under 35 U.S.C. §371 of International Application No. PCT/IB2013/053740, filed on May 9, 2013, which claims the benefit of U.S. Provisional Patent Application No. 61/649,390, filed May 21, 2012. These application are hereby incorporated by reference herein.

TECHNICAL FIELD

The present invention relates to a method of running up a discharge lamp, in particular a UHP (ultra high performance) or HID (high intensity discharge) lamp, in which a driving electrical power is increased to a target value during a single or during two or more consecutive time periods. The invention also relates to a driving device for a discharge lamp which is adapted to run-up the discharge lamp according to the proposed method.

BACKGROUND OF THE INVENTION

Traditional UHP systems use a current-driven run-up scheme to heat up lamps after ignition. The current level is typically kept constant for a given time or until some conditions on lamp voltage are reached, after which the lamp is driven by a new constant current. A transition to the new current level can be smoothened by using a slow ramp and this process can be iterated a few times. In a typical run-up scheme the current level is increased stepwise several times until the target power level of the lamp is reached.

It is very difficult to design such schemes, i.e. the stepwise increase of the current, for the whole lamp voltage range, especially when lamp cooling is not in control by the lamp driver. This may lead to electrode tip damages due to high current peaks and determine a decrease of lamp performance, for example by decreasing lamp lifetime. It is important to notice that a lamp cooling has a big influence on lamp voltage both during transient and during steady state operation. In the majority of lamp systems currently available in the market the lamp driver has no control on the intensity of lamp cooling.

Among the requirements for running up a UHP lamp there are some limitations within which the lamp brightness must have reached a given percentage of its final value within a relatively short time. In order to achieve this requirement for a lamp which has a relatively low voltage value during its steady state operation, the level of currents used have to be significantly high and sometimes can exceed the maximum load for the lamp itself. This can temporarily damage the electrode tip and generate a brightness drop that, although recoverable, will be perceived and measured as a loss in performance. Moreover, the repeated operation at high current levels could permanently damage the lamp and reduce its lifetime. On the other hand, in case the lamp voltage during steady state is sufficiently high—which is the case after several hundreds or thousands hours of operation—driving it with relatively high currents during run-up can also lead to abnormal burn-back of the electrode tips. This in turn means reduced lifetime and reliability level.

WO 2006/072858 A2 discloses a lighting assembly and method of operating a discharge lamp, in which a method of running up the discharge lamp is described which is at least partly based on a power control. The lamp is operated in a first turn-on interval with increasing electrical power, but only up to an initial maximum power value less than the nominal power of the lamp. Then, during a power ramp interval, the lamp is operated with increasing electrical power over time. The electrical power increases from the initial maximum power value to nominal power. This power ramp interval is initiated at a time where the lamp has already reached initial stable operation conditions in order to achieve a reduction of electrode distance which is considered to limit electrode burn-back. This method of running up a discharge lamp, however, does not avoid current peaks.

DESCRIPTION OF THE INVENTION

It is an object of the present invention to provide a method of running up a discharge lamp, in particular a UHP or HID lamp, and a corresponding driving device, which allow a running up of the discharge lamp with reduced risk of overheating of the electrode tips of the lamp independent on lamp cooling, or reduced risk of damaging the burner of the lamp.

The object is achieved with the method and driving device according to claims 1 and 12. Advantageous embodiments of the method and driving device are subject matter of the dependent claims or are disclosed in the subsequent portions of the description and embodiments.

In the proposed method of running up the discharge lamp the driving electrical power is controlled, that is: the driving electrical power is increased or decreased to a target value during a single time period, or during two or more consecutive time periods. For the sake of clarity, the description hereinafter, in reference to the figures, will be based on exemplary embodiments wherein the driving electrical power is adjusted to the target value during a single time period or during two consecutive time periods. The current invention is not limited to such exemplary embodiments, and it may be advantageous in practical situations, that a desired power profile be defined based on more than two consecutive time periods. In the case of running up the lamp during two consecutive time periods, the driving current of the lamp is controlled to be constant during the first of said consecutive time periods. This first time period is shorter than the second time period and has a duration of preferably less than 40% of the second time period, more preferably less than 10% of the second time period. This current control then switches to a power control which is applied during the second time period. In this second time period the driving power of the lamp is controlled to reach the target value. In case of the running up the lamp during a single time period, the driving power of the lamp is controlled to reach the target value during this single time period. At the same time during the single or during the second time period the driving current of the lamp is not allowed to increase faster than a preset rate and is not allowed to exceed a fixed upper current limit, which can be selected to avoid an overheating of electrodes of the lamp. In cases where more than two consecutive time periods are used, what applies to the second period in the description above and hereafter can apply to the last period.

With the proposed method the run-up phase with a constant or piecewise current is replaced by a power driven profile which has a fixed (programmable) duration and which terminates at the final requested power level (target value). This applies independently on steady state lamp voltage and on lamp cooling and avoids so the drawback of having to cope with a big range of lamp voltages with a scheme based on fixed current levels. In this patent application the term "run up" relates to the start-up of the lamp after ignition or to the resuming of the lamp from a standby state, i.e. from a state with extremely low power. The following description relates to the running up after ignition of the lamp, but the same description may also be applied to the transition phase from a standby state to steady state.

In the first phase (first time period) of an embodiment of the method just after the ignition phase has finished, the driver will generate a fixed current for a short time, i.e. a few seconds to a few tens of seconds, to enable for example an estimate of the lamp voltage: preferably the current can be kept constant for a period of time that is shorter than 30 seconds, or preferably shorter than 10 seconds. The value for the fixed current in this first phase or time period will be retrieved from driver memory and it will be either a constant value or it will equal the last used value during previous steady state operation of the lamp. After this first phase is finished, the driver will calculate the instantaneous output power and it will start generating an output power profile in order to reach the final output power (target value) at the end of a predetermined time, the second time period. In the simplest implementation this course or profile could be linear, but more elaborate time profiles can also be applied. In this second phase of generating an output power profile and controlling the driving power, a further algorithm is used to avoid that the current requested to follow the output power profile can become too high and/or increases too fast. In an advantageous embodiment of the method, the current is only allowed to be lower or equal than a given dynamic or adaptive maximum current level, in the following also denoted as clipping value. This adaptive maximum current level is allowed to increase or decrease only with predetermined (configurable) rates. In case the requested current to follow the power profile exceeds the instantaneous clipping value, the latter will be increased by a given factor or amount, allowing the current to be clipped to a higher value. On the contrary, if the requested current becomes lower than the instantaneous clipping value, the latter is reduced with a given rate. This adaptive maximum current level is limited in its operating range by (configurable) absolute maximum and minimum levels. The maximum level is the fixed upper current limit which avoids overheating of the electrode tips.

In case of running up the lamp during a single time period the above method steps of the second time period are carried out during the single time period.

The proposed driving device comprises connection terminals for applying electrical power to the electrodes of the discharge lamp and a driver running up the discharge lamp by increasing or decreasing the driving power to a target value during a single or during two consecutive time periods, or possibly during more consecutive time periods. In exemplary embodiments wherein two consecutive time periods are considered, the driver is designed to generate a constant driving current during the first of said two consecutive time periods, if applicable, and to generate an increasing or decreasing driving power and control the driving power to reach the power target value during the single or second time period. In most cases the driver is designed to generate an increasing driving power, though in specific cases it may be preferred that for instance the lamp power be at least temporarily reduced, for example when a lamp burner shall be pre-heated during a first time period by a relatively high current. The driver is also designed to control the driving current of the lamp during the single or second time period such that the driving current does not increase faster than a preset limited rate and does not exceed a fixed upper current limit. The driver preferably includes a programmable control unit for implementing the proposed run-up method and also preferably provides input means for receiving the target value and at least one of the first and second time periods, if applicable, the fixed upper current limit, the starting adaptive current limit and the preset course of increase of the power.

The proposed method and driving device can be applied for HID, in particular UHP lamps. The method and driving device in particular allow a smooth transition from ignition phase to steady state.

These and other aspects of the invention will be apparent from and elucidated with reference to the embodiments described herein after.

BRIEF DESCRIPTION OF THE DRAWINGS

The proposed method and driving device are described in the following by way of examples in connection with the accompanying figures in further detail. The figures show.

DETAILED DESCRIPTION OF EMBODIMENTS

Figure 1:
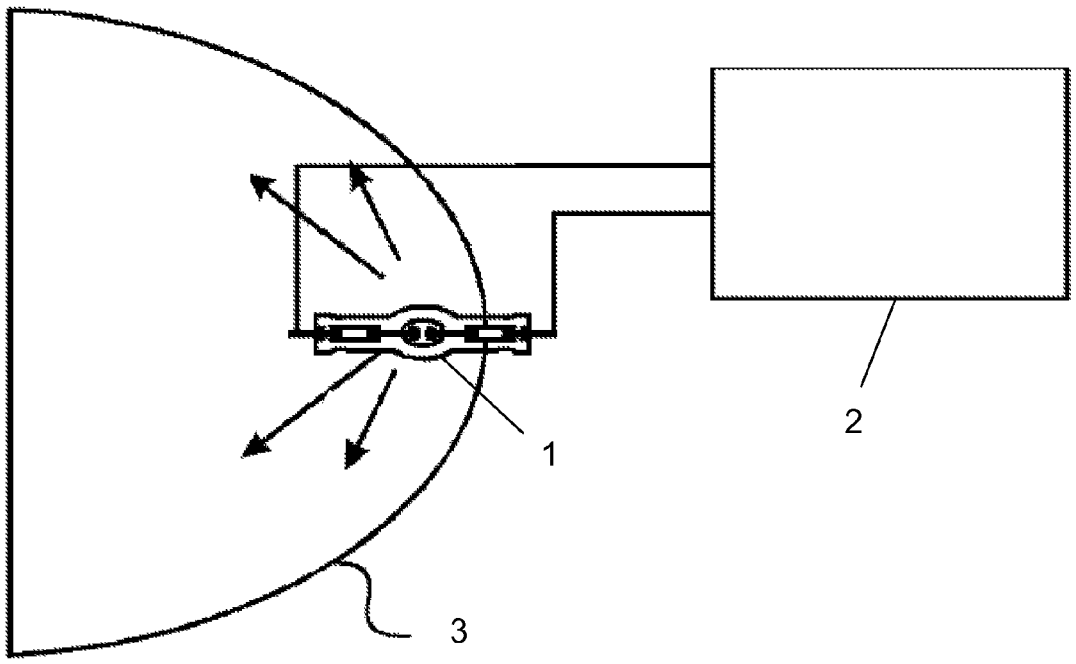
FIG. 1 a lighting assembly including a discharge lamp and a driving device according to the present invention.

FIG. 1 shows an example of a lighting assembly including a UHP lamp 1 and a driving device 2. The UHP lamp 1 may be part of an optical system, e.g. a projector, a component of which is shown in form of reflector 3. The UHP lamp 1 is connected to the two connection terminals of the driving device 2 which allow the application of electrical power to the electrodes of the UHP lamp 1.

Such a driving device also takes care of the ignition of the UHP lamp 1 by applying a high voltage pulse to the lamp. After ignition of the lamp, the driver of the driving device 2 performs the running up of the lamp to a target power value according to the proposed method. In this method the driver switches from current control to power control after a relatively short time and applies the power control in combination with an appropriate limitation of the maximum value and the rate of change of the current. Due to the proposed method, a uniform power and brightness profile can be achieved for different lamps during lifetime.

The operation of the driver of the driving device 2 is preferably based on appropriate algorithms which are incorporated in the driver. The running up of the lamp is subdivided into two consecutive time periods. In the first time period the driver generates a constant driving current for the lamp. The length of the first time period $T_1$ is in this embodiment set to a relatively short time of approximately 1 to 5 s. As an alternative, the length of the first time period $T_1$ can also be triggered by the lamp voltage $V_{la}$. In this alternative a threshold lamp voltage $V_{th}$ is set to be significantly lower than the target value. As soon as the lamp voltage $V_{la}$ reaches the threshold value $V_{th}$, the first time period $T_1$ ends and the second time period $T_2$ begins. The initial current of the first time period may be a predetermined fixed value or may also be selected the same as the last used current during previous steady state operation of the lamp.

At the beginning of the second time period $T_2$ the start power $P_S$ is calculated as $P_S=V_{la}\cdot I_1$, wherein $I_1$ is the initial constant current during the first time period $T_1$. The start power $P_S$ will be the power to be applied at the beginning of the second time period $T_2$. If the value of $P_S$ exceeds the value of $P_N$ (nominal power=target value), the second time period is skipped and the driver will directly go to a power curve state. This is for example the case when the lamp is seriously damaged.

The power is increased in small linear steps in this embodiment to reach its final value $P_N$ after a time equal to the length of the second time period $T_2$. The power must change with an average slope of $(P_N-P_S)/T_2$ [W/s].

The current is clipped to an adaptive maximum value during the second time period. The parameters for this dynamic or adaptive maximum value $I_{dmax}$ will be stored in the driver and uses in this example two parameter $L_{dup}$ and $I_{ddown}$ limiting the rate of increase and decrease of $I_{dmax}$. $I_{dup}$ and $I_{ddown}$ contain the step-up and step-down values for $I_{dmax}$. Different values may be used for step-up and step-down. If the current requested exceeds $I_{dmax}$, $I_{dmax}$ is increased with $I_{dup}$ and the current can follow this increase. On the other hand, if the requested current decreases below $I_{dmax}$, $I_{dmax}$ will be lowered with $I_{ddown}$ $I_{dmax}$ has an upper limit which is the maximum fixed current allowable in order to avoid an overheating of the electrodes of the lamp.

Figure 2:
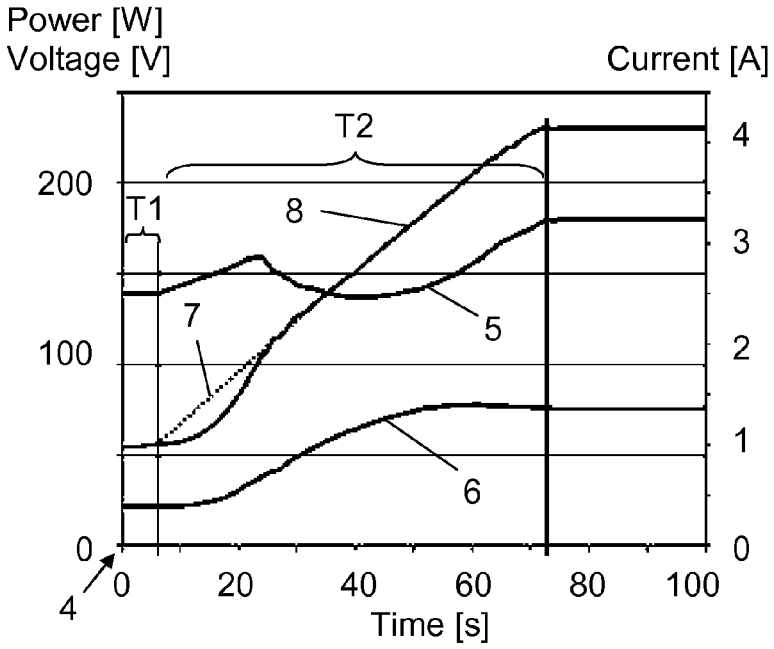
FIG. 2 the values of current, power and voltage during the running up of a lamp according to the present invention.

FIG. 2 shows the voltage, current and power during the run-up period of the proposed method as an example. After ignition 4 of the lamp at the time T=0s in FIG. 2 the current 5 is first kept constant during a short time period $T_1$. The power after $T_1$ is determined and then increased during $T_2$ according to an appropriate power profile to reach the target value $P_N$ during the second time period $T_2$. The figures show the course of the voltage 6 and of the applied current 5. In this example, a linear power profile 7 is preset or calculated in order to reach the target value within the second time value $T_2$. However, due to the limitations of the change rate of the current according to the present invention, the real power profile which is applied during the second time period deviates from the preset or calculated linear profile. This is shown with the solid line of generated power 8 which only approaches the desired profile. Due to the applied limitation of the current, no fast current changes and thus no current peaks occur which may lead to an over heating of the electrodes.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. In particular, all dependent claims of the method can be freely combined if such a combination makes sense. Any reference signs in the claims should not be construed as limiting the scope.

LIST OF REFERENCE SIGNS

1 UHP lamp
2 Driving device
3 Reflector
4 Ignition
5 Current
6 Voltage
7 Preset/calculated power profile
8 Generated power profile

The invention claimed is:

1. A method of running up a discharge lamp by controlling a driving power to a target value during a single or during two or more consecutive time periods, wherein an instantaneous output power is calculated based on an estimate of the discharge lamp voltage, the driving power of the lamp being controlled to reach the power target value during the single or during a last period of said two or more consecutive time periods, wherein a driving current of the lamp is not allowed during the single or second time period to increase faster than a preset rate and to exceed a fixed upper current limit; and wherein an adaptive upper current limit is set which the driving current is not allowed to exceed, the adaptive upper limit being increased by a first present amount every time when the current requested exceeds the adaptive upper limit, and being lowered by a second present amount every time when the driving current decreases.

2. The method according to claim 1, wherein the driving current of the lamp is controlled to keep constant during the first of said two consecutive time periods.

3. The method according to claim 2, wherein the step of controlling the driving power of the lamp includes the sub-steps of determining a start driving power applied at the end of the first time period, calculating a power slope required to reach the power target value during the second time period when starting with the start driving power.

4. The method according to claim 1, wherein a target course of increasing of the driving power is controlled to achieve or at least approach the preset course.

5. The method according to claim 2, wherein the first time period is selected to have a duration of less than 40% of the second time period.

6. The method according to claim 2, wherein the first time period is selected to have a duration of less than 10% of the second time period.

7. The method according to claim 2, wherein said first time period is selected to have a fixed duration of less than 30 seconds.

8. The method according to claim 2, wherein said first time period is selected to have a fixed duration of less than 10 seconds.

9. The method according to claim 2, wherein said first time period is controlled to end as soon as a preset intermediate power level has been reached, said intermediate power level having a value which is between 20% and 40% of said target value of the power.

10. The method according to claim 2, wherein said driving current in said first time period is set to a preset constant value.

11. The method according to claim 2, wherein said driving current in said first time period is selected to equal a driving current used during a most recent steady state operation of the lamp.

12. The method according to claim 2, wherein said consecutive time periods are selected to achieve a steady state operation of the lamp at the end of the second time period.

13. A driving device for a discharge lamp comprising connection terminals for applying electrical power to the electrodes of the discharge lamp, and a driver running up the discharge lamp by increasing a driving power to a target value during a single or during two consecutive time periods, the driver being adapted to estimate the discharge lamp voltage and calculate an instantaneous output power, said driver being designed to generate an increasing driving power and controlling the driving power to reach the power target value during the single or during a second of said two consecutive time periods, wherein the driver does not allow the driving current during the single or second time period to increase faster than a preset rate and to exceed a fixed upper current limit, which is selected to avoid an overheating of electrodes of the lamp; and wherein an adaptive upper current limit is set which the driving current is not allowed to exceed, the adaptive upper limit being increased by a first present amount every time when the current requested exceeds the adaptive upper limit, and being lowered by a second present amount every time when the driving current decreases.

14. The driving device according to claim 13, wherein the driver is designed to generate a constant driving current during the first of said two consecutive time periods.

* * * * *